US007073202B1

(12) United States Patent
Geary

(10) Patent No.: US 7,073,202 B1
(45) Date of Patent: Jul. 11, 2006

(54) WRIST PROTECTOR

(76) Inventor: John A. Geary, 11 Winnecunnet Way, Easton, MA (US) 02375

( * ) Notice: Subject to any disclaimer, the term of this patent is extended or adjusted under 35 U.S.C. 154(b) by 0 days.

(21) Appl. No.: 11/265,592

(22) Filed: Nov. 2, 2005

Related U.S. Application Data

(60) Provisional application No. 60/719,853, filed on Sep. 22, 2005.

(51) Int. Cl.
*A41D 13/08* (2006.01)

(52) U.S. Cl. ..... 2/16; 602/64

(58) Field of Classification Search ..... 2/16, 2/20, 22, 24, 59, 61, 91, 123, 242, 270, 124–126, 2/911, 917, 918, 60, 170, 268; 602/3, 21, 602/61–64
See application file for complete search history.

(56) References Cited

U.S. PATENT DOCUMENTS

| | | | | |
|---|---|---|---|---|
| 1,128,122 | A | | 2/1915 | Fox |
| 1,253,260 | A | | 1/1918 | Levinson |
| 3,459,179 | A | | 8/1969 | Olesen |
| 3,712,623 | A | | 1/1973 | Donnald |
| 4,142,252 | A | | 3/1979 | Storer |
| 4,422,183 | A | | 12/1983 | Landi et al. |
| 4,472,472 | A | | 9/1984 | Schultz |
| 4,642,814 | A | | 2/1987 | Godfrey |
| 5,119,513 | A | * | 6/1992 | McKay ..... 2/181 |
| 5,143,762 | A | | 9/1992 | Ho |
| 5,307,521 | A | | 5/1994 | Davis |
| 5,329,638 | A | * | 7/1994 | Hansen et al. ..... 2/16 |
| D353,119 | S | | 12/1994 | Greeley et al. |
| 5,423,087 | A | | 6/1995 | Krent et al. |
| 5,545,128 | A | | 8/1996 | Hayes et al. |
| 5,557,803 | A | | 9/1996 | Granich et al. |
| 5,647,062 | A | | 7/1997 | Nigbur |
| 5,733,249 | A | * | 3/1998 | Katzin et al. ..... 602/21 |
| 5,781,935 | A | | 7/1998 | Bassett et al. |
| 5,983,391 | A | | 11/1999 | Palmer et al. |
| D431,693 | S | | 10/2000 | Urquhart et al. |
| 6,139,486 | A | * | 10/2000 | Matuszewski et al. ..... 600/15 |
| 6,336,220 | B1 | | 1/2002 | Sacks et al. |
| 6,432,513 | B1 | | 8/2002 | Thomsen et al. |
| 6,785,909 | B1 | | 9/2004 | Li |

* cited by examiner

*Primary Examiner*—Tejash Patel
(74) *Attorney, Agent, or Firm*—John P. McGonagle

(57) ABSTRACT

An elasticized terry cloth band with a foam rubber insert having a plurality of parallel ridges. The cloth band is worn about a person's limb or head. The ridges face away from the limb or head being protected. The ridges provide additional force absorbent means and also provide means for redirecting the axis of a portion of a blow's force.

20 Claims, 5 Drawing Sheets

FIG. 2
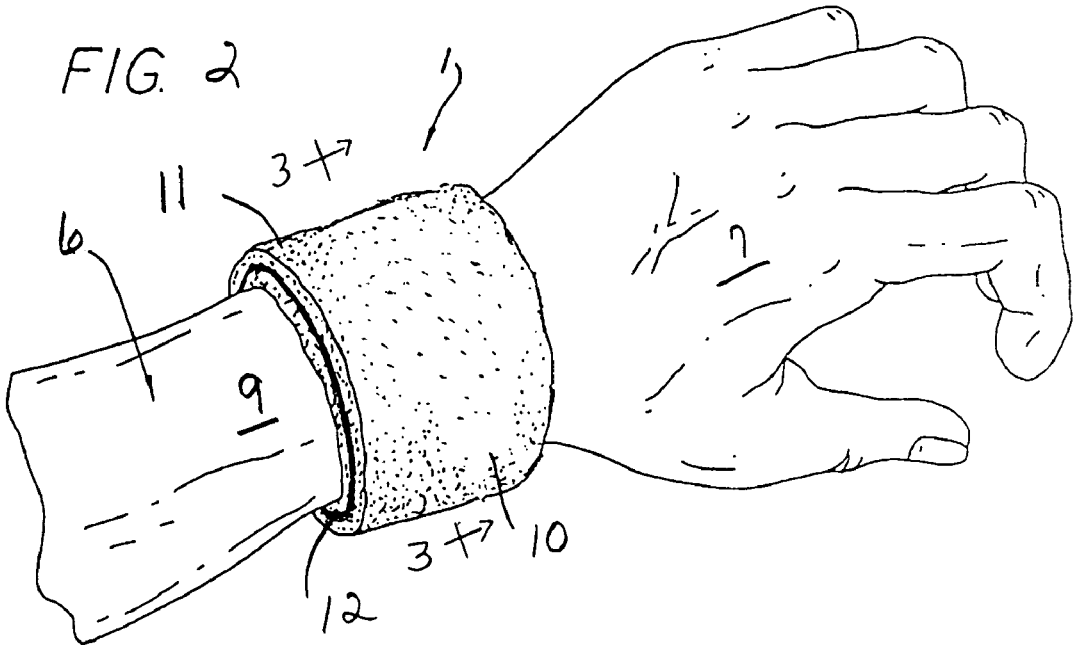
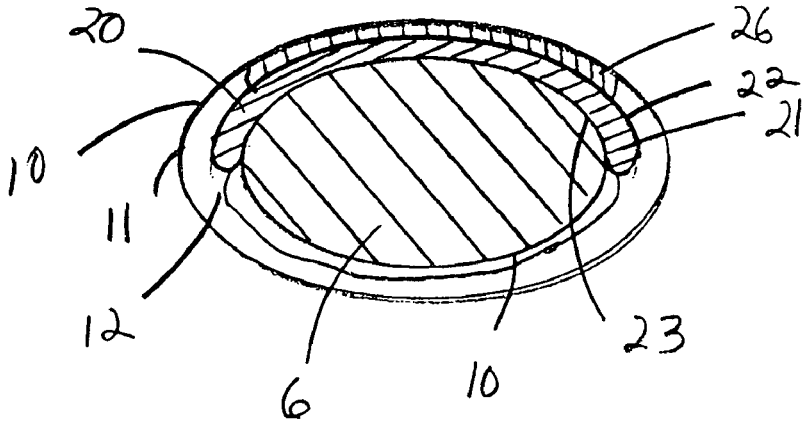
FIG. 3

WRIST PROTECTOR

CROSS-REFERENCE TO RELATED APPLICATIONS

Applicant claims the priority benefits of U.S. Provisional Patent Application No. 60/719,853, filed Sep. 22, 2005.

BACKGROUND OF THE INVENTION

This invention relates to protective devices, and in particular, to a wrist protector having an insert member.

Injuries to limbs are common in many contact sports. For instance, in hockey and lacrosse, and other sports in which a stick is used, a player's wrists and forearms are subject to both intentional and inadvertent contact by another player's stick. This is also true with baseball, where a player is vulnerable to an inside pitched ball. With the onset of shorter player gloves, the space between the player's elbow pad and the glove has increased, thereby exposing more of the player's arm and increasing the chance of injury. Presently developed forearm protectors include terry cloth wristbands with hard molded poly inserts. A wristband of this type translates the force of a blow directly to the wrist along the axis of the blow's force.

SUMMARY OF THE INVENTION

The present invention provides an elasticized terry cloth wristband with a foam rubber insert contained within, said insert having a plurality of parallel ridges. The ridges face away from the limb and lay generally transversely to the longitudinal axis of the limb being protected. The ridges not only provide additional force absorbent means, but also provide means for redirecting the axis of a portion of a blow's force.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIG. 2 is a perspective view of the protector worn on a wrist.

FIG. 3 is a cross sectional view along the line 3—3 of FIG. 2.

DETAILED DESCRIPTION OF INVENTION

Figure 1:
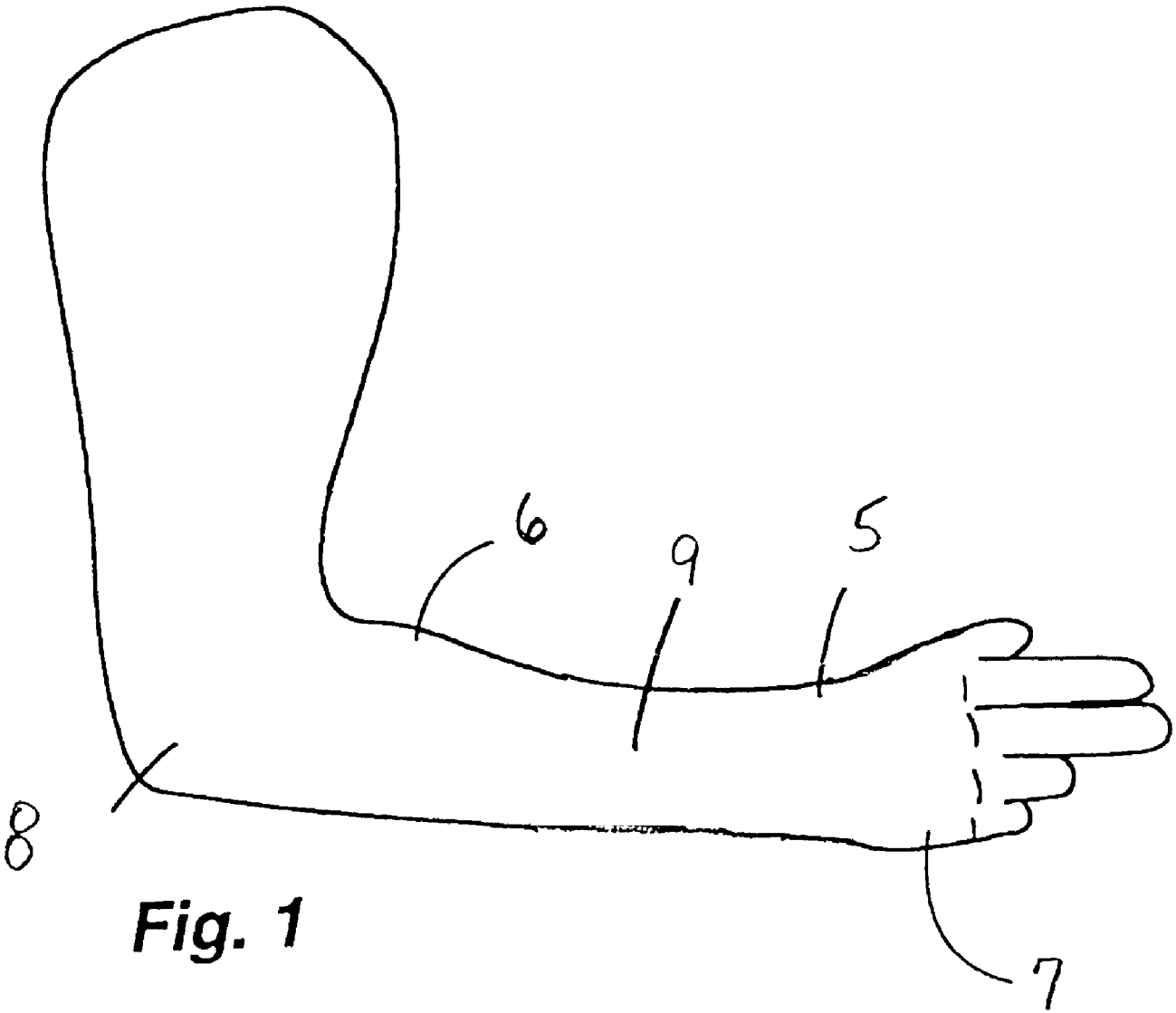
FIG. 1 is a side perspective view of a human arm.
Figure 4:
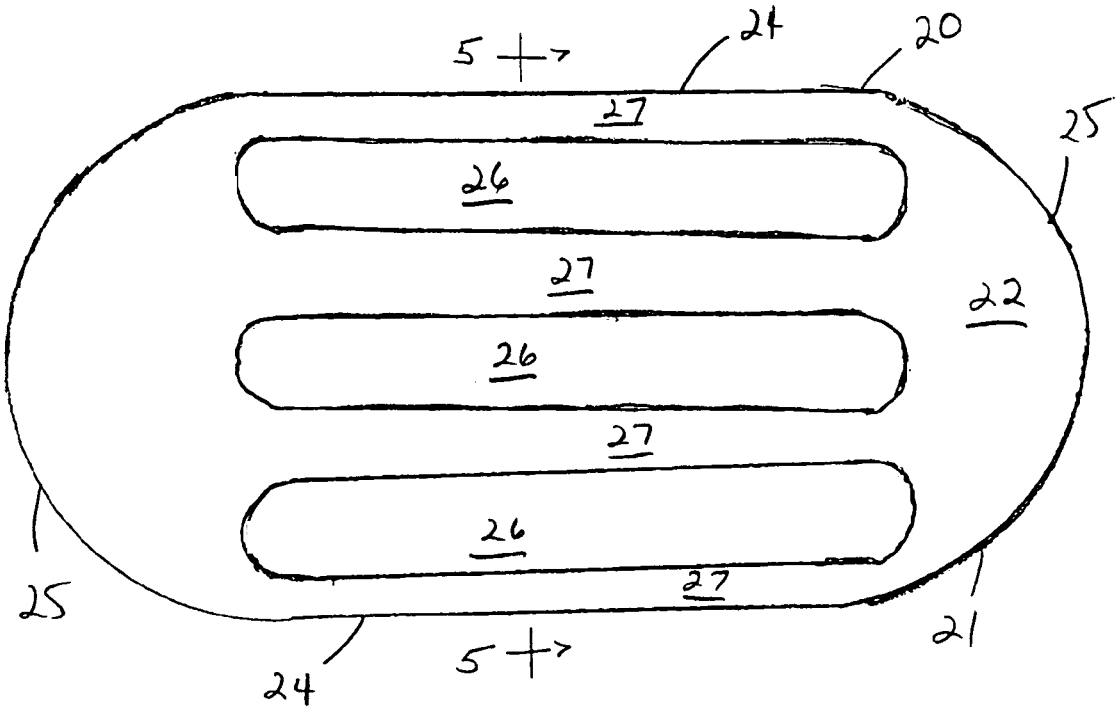
FIG. 4 is a top view of the insert.
Figure 5:
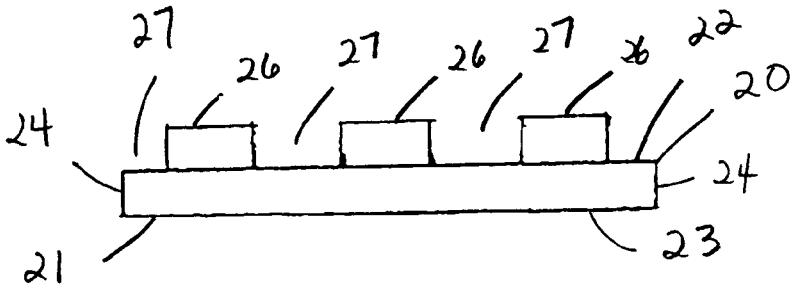
FIG. 5 is a cross sectional view along the line 5—5 of FIG. 4.
Figure 6:
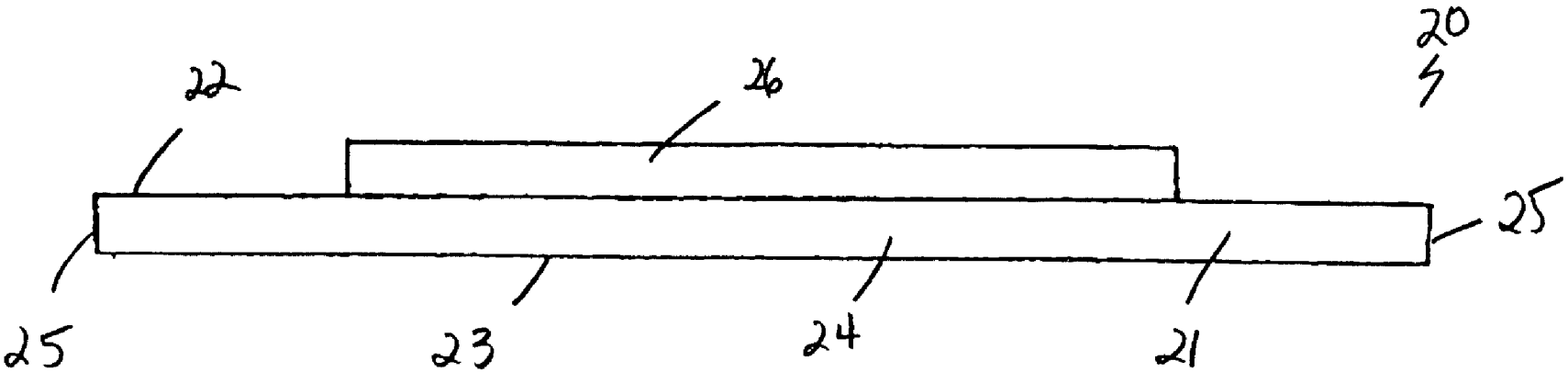
FIG. 6 is a side view of the insert.
Figure 7B:
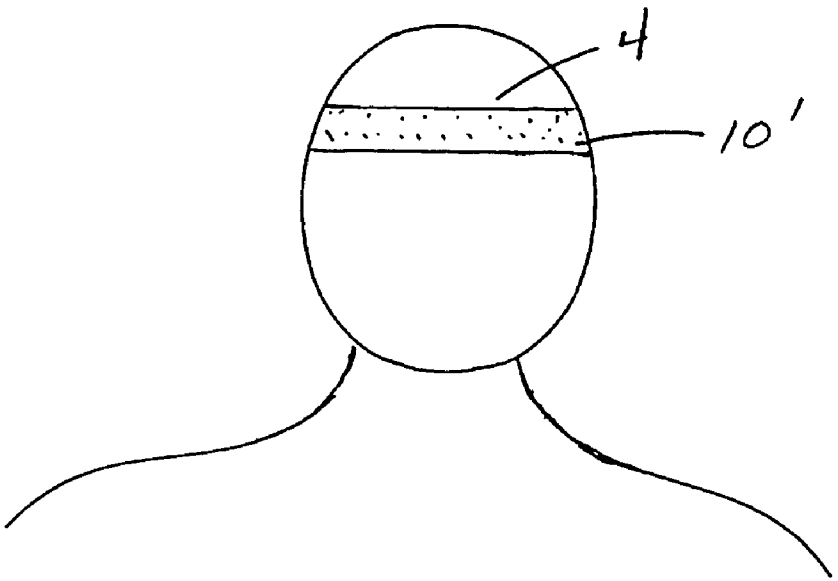
FIG. 7B is a front view of the protector worn about a head.
Figure 7A:
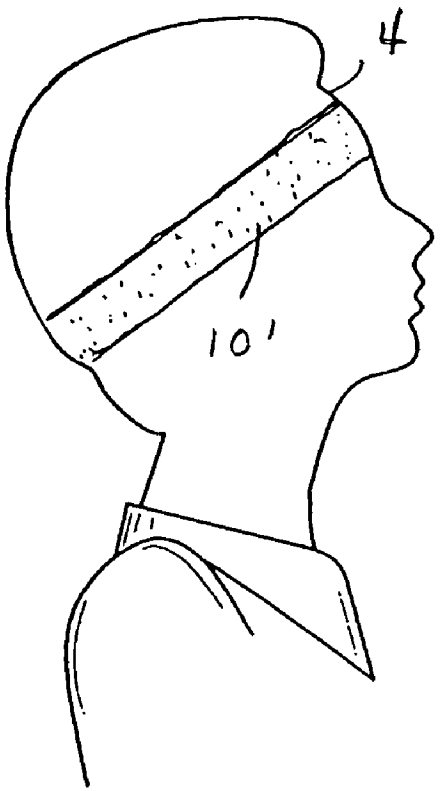
FIG. 7A is a side view of the protector worn about a head.

Referring to the drawings in detail wherein like elements are indicated by like numerals, there is shown a wrist protector 1 constructed according to the principles of the present invention, said wrist protector being comprised of an elasticized terry cloth wrist band 10 worn on the wrist 5 of a wearer, said wrist band having an insert 20. The wearer's forearm 6 has a longitudinal axis defined by the wearer's hand 7 and elbow 8. The wrist band 10 has a portion 11 folded over itself forming a pocket 12. The insert 20 is fitted into the pocket 12.

The insert 20 has a generally flat body 21 having a generally rectangular shape having rounded corners. The insert body 21 has a top surface 22, opposite bottom surface 23, two opposite long side edges 24, and two opposite short edges 25, said short edges 25 defining an insert longitudinal axis. The insert 20 is further comprised of a plurality of elongated, spaced, parallel strips 26 attached to the body top surface 22. The strips 26 have a generally rectangular cross section. Each strip 26 has a longitudinal axis parallel to the insert longitudinal axis. Each strip 26 is glued to the insert top surface 22. The elongated spaces 27 between strips 26 have an approximate width equal to each strip width. The insert body 21 and each strip 26 is made from a high density foam rubber or comparable material.

The insert 20 is positioned within the wrist band 10 so that the insert longitudinal axis is coincident with a wrist band circumferential axis and transverse to the wearer's forearm longitudinal axis. Since the force of an external blow is usually felt on the top surface of the forearm, the wrist protector 1 is positioned and worn so that the insert 20 is positioned adjacent the forearm top surface 9 and the insert bottom surface 23 is facing the wearer's forearm 6.

The advantage of the present invention, lies in the spaced strips attached to the top surface of the insert body. Prior art protectors have no way of dissipating external forces, except by direct cushioning and absorption. Because of the bulky nature of soft padding used to absorb external forces, most sports players wear thin pads sacrificing the ability to absorb and cushion external blows. After the pad's absorption limit is reached, the resultant external force is transferred directly to the underlying limb. The present invention overcomes this problem by providing means to not only absorb external forces but to also redirect a portion of the force.

The insert strips 26 first encounter an external force. The strips 26 provide some cushioning and absorption of the force. However, as the strips 26 are squashed into the insert top surface 22, the strips 26 expand sideways into the adjacent spaces 27 thereby redirecting some of the external force sideways away from the limb underlying the wrist protector 1. The rectangular cross section of the strips 26 also provides a sideways tipping action into the adjacent open spaces 27, especially from sharp external blows striking the wrist protector at other than a 90 degree angle. In both cases a substantial portion of the external force is either cushioned and absorbed or redirected away from the underlying limb. The insert body 21 also provides cushioning and force absorption.

The present invention is also useful for protecting the forehead of a soccer player. It is becoming increasingly apparent to the soccer world that striking a soccer ball with the forehead, a useful playing technique, is detrimental to the long and short term health of a player. However, since the technique of "heading", i.e., striking a ball with the forehead, is an integral part of the game, heading will simply not be banned. Therefore, some type of light weight protection, capable of absorbing the shock of a ball strike, is very important. The present invention is particularly useful for this application. For this application, the invention insert 20 is be contained within a head sweatband 10'. The insert 20 is be positioned adjacent a player's forehead 4. In use, this form of the invention would either cushion and absorb or redirect away from the underlying forehead a substantial portion of the external force from a soccer ball.

It is understood that the above-described embodiments are merely illustrative of the application. In the embodiments of the invention described, the insert thickness from top surface to bottom surface is from ¼ inch to 3/16 inch. Each strip is ½ inch wide and ¼ inch in height. Three strips are used, but more or less may be used. The insert is sewed within the sweatband. Other embodiments may be readily devised by those skilled in the art which will embody the principles of the invention and fall within the spirit and scope thereof.

I claim:

1. A protector, comprising:

an elasticized terry cloth wrist band worn on a forearm of a wearer, said wearer's forearm having a longitudinal axis defined by a wearer's hand and elbow, said wrist band having a portion folded over itself forming a pocket;

an insert contained within said wrist band pocket, said insert comprising:

a generally flat body having a top surface, an opposite bottom surface, two opposite long side edges, and two opposite short edges, said short edges defining an insert longitudinal axis;

a plurality of elongated, spaced, parallel strips attached to the body top surface.

2. A protector as recited in claim 1, wherein:

each strip has a generally rectangular cross section, each strip having a longitudinal axis parallel to the insert longitudinal axis.

3. A protector as recited in claim 2, wherein:

each strip has a space between each adjacent strip having a width approximately equal to a strip width.

4. A protector as recited in claim 3, wherein:

the insert body and each strip is made from a high density foam rubber material.

5. A protector as recited in claim 4, wherein:

the insert is positioned within the wrist band so that the insert longitudinal axis is coincident with a wrist band circumferential axis and transverse to the wearer's forearm longitudinal axis.

6. A protector as recited in claim 5, wherein:

the protector is positioned and worn so that the insert is positioned adjacent a forearm top surface and the insert bottom surface is facing the wearer's forearm.

7. A protector as recited in claim 6, wherein:

each said strip is adapted to expand sideways into adjacent spaces as an external force is applied to said protector.

8. A protector as recited in claim 7, wherein:

each said strip is adapted to tip sideways into adjacent spaces as an external force is applied to said protector at other than a 90 degree angle.

9. A protector as recited in claim 8, wherein:

said insert body has a generally rectangular shape with rounded corners.

10. A protector as recited in claim 9, wherein:

each strip is glued to the insert body top surface.

11. A protector, comprising:

an elasticized terry cloth headband worn about the forehead of a wearer, said wearer's forehead having a longitudinal axis defined by a wearer's forehead width, said headband having a portion folded over itself forming a pocket;

an insert contained within said headband pocket, said insert comprising:

a generally flat body having a top surface, an opposite bottom surface, two opposite long side edges, and two opposite short edges, said short edges defining an insert longitudinal axis;

a plurality of elongated, spaced, parallel strips attached to the body top surface.

12. A protector as recited in claim 11, wherein:

each strip has a generally rectangular cross section, each strip having a longitudinal axis parallel to the insert longitudinal axis.

13. A protector as recited in claim 12, wherein:

each strip has a space between each adjacent strip having a width approximately equal to a strip width.

14. A protector as recited in claim 13, wherein:

the insert body and each strip is made from a high density foam rubber material.

15. A protector as recited in claim 14, wherein:

the insert is positioned within the headband so that the insert longitudinal axis is coincident with a head band circumferential axis and parallel to the wearer's forehead longitudinal axis.

16. A protector as recited in claim 15, wherein:

the protector is positioned and worn so that the insert is positioned adjacent a forehead top surface and the insert bottom surface is facing the wearer's forehead.

17. A protector as recited in claim 16, wherein:

each said strip is adapted to expand sideways into adjacent spaces as an external force is applied to said protector.

18. A protector as recited in claim 17, wherein:

each said strip is adapted to tip sideways into adjacent spaces as an external force is applied to said protector at other than a 90 degree angle.

19. A protector as recited in claim 18, wherein:

said insert body has a generally rectangular shape with rounded corners.

20. A protector as recited in claim 19, wherein:

each strip is glued to the insert body top surface.

* * * * *